US008267555B1

(12) United States Patent
Tsai

(10) Patent No.: US 8,267,555 B1
(45) Date of Patent: Sep. 18, 2012

(54) LAMP

(75) Inventor: Chi-Tsung Tsai, Kaohsiung (TW)

(73) Assignee: Sunonwealth Electric Machine Industry Co., Ltd., Kaohsiung (TW)

( * ) Notice: Subject to any disclaimer, the term of this patent is extended or adjusted under 35 U.S.C. 154(b) by 0 days.

(21) Appl. No.: 13/115,759

(22) Filed: May 25, 2011

(30) Foreign Application Priority Data

Mar. 17, 2011 (TW) ..... 100109163 A

(51) Int. Cl.
*F21V 29/00* (2006.01)

(52) U.S. Cl. ..... 362/373; 362/294

(58) Field of Classification Search ..... 362/96, 362/218, 294, 345, 373
See application file for complete search history.

(56) References Cited

U.S. PATENT DOCUMENTS 6,733,157 B1 * 5/2004 Shyu et al. ..... 362/294
6,739,736 B2 5/2004 Liao
7,364,308 B2 4/2008 Murasugi
7,575,346 B1 * 8/2009 Horng et al. ..... 362/373
8,115,395 B2 * 2/2012 Horng et al. ..... 315/117
8,118,462 B2 * 2/2012 Inoue et al. ..... 362/547
2011/0032491 A1 2/2011 Tsai et al.

* cited by examiner

*Primary Examiner* — Thomas Sember
(74) *Attorney, Agent, or Firm* — Muncy, Geissler, Olds & Lowe, PLLC

(57) ABSTRACT

A lamp includes a heat conducting member, a light-emitting module, a housing and a cooling fan. The heat conducting member has a first face and a second face opposite to the first face. The light-emitting module is coupled with the first face. The housing is coupled with the heat conducting member and has a terminal opening, wherein first and second air-guiding openings are formed between the terminal opening and the heat conducting member. The housing has an inner circumferential wall. An air-flowing room is formed between the inner circumferential wall and the second face. The air-flowing room communicates with the first air-guiding opening and the second air-guiding opening. The cooling fan is disposed at the first or second air-guiding opening and has first and second air-driving openings, wherein the first air-driving opening faces the air-flowing room and the second air-driving opening faces the first or second air-guiding opening.

14 Claims, 10 Drawing Sheets

LAMP

BACKGROUND OF THE INVENTION

1. Field of the Invention

The present invention generally relates to a lamp and, more particularly, to a lamp with a cooling function.

2. Description of the Related Art

FIG. 1 shows a conventional lamp 7 having a light-emitting module 71 that provides an illumination function. In FIG. 7, the heat generated during operation of the light-emitting module 71 could deteriorate the operation of the light-emitting module 71 if the conventional lamp 7 is not equipped with any cooling apparatus. This could further shorten the service life of the conventional lamp 7. In light of this, the light-emitting module 71 of the conventional lamp 7 is usually coupled with a heat sink 72 to absorb the heat generated by the light-emitting module 71, avoiding the light-emitting module 71 from generating a massive amount of heat.

Although the light-emitting module 71 can obtain longer service life by using the heat sink 72, the light-emitting module 71 will inevitably generate a great deal of heat while emitting lights with greater brightness. At this point, the heat sink 72 alone can not prevent the light-emitting module 71 from overheating. Furthermore, since the heat sink 72 has a larger volume, the conventional lamp 7 will be heavier, resulting in inconvenience in use.

Referring to FIG. 2, another conventional lamp 8 is disclosed by Taiwanese Patent No. I316121 entitled "lamp". The conventional lamp 8 includes a housing 81 consisting of a first housing 811 and a second housing 812. Both the first housing 811 and the second housing 812 have an air outlet portion 811*a* and an air inlet portion 812*a*. The first housing 811 has a heat sink 82, a light-emitting element 83 and a cooling fan 84 disposed therein, with the heat sink 82 located between the light-emitting element 83 and the cooling fan 84. In such an arrangement, the cooling fan 84 may draw air via the air inlet portion 812*a* and expel air via the air outlet portion 811*a*. Thus, the housing 81 may form an air-guiding room therein that allows air circulation and provides cooling effect.

Although the conventional lamp 8 is equipped with the cooling fan 84 for cooling purpose, the air-guiding room in the housing 81 has a complex shape. This hinders the air from smoothly flowing in the air-guiding room, degrading the cooling performance of the conventional lamp 8 and increasing the structural complexity of the conventional lamp 8. Furthermore, when the cooling fan 84 draws and guides air to flow past the heat sink 82, the dust contained in the air may accumulate on the cooling fan 84 and the heat sink 82. To wipe the dust off the cooling fan 84, the first housing 811 and the second housing 812 should be removed apart to take out the cooling fan 84 as the cooling fan 84 is located between the air outlet portion 811*a* and the air inlet portion 812*a*. This results in an inconvenient in cleaning the conventional lamp 8.

Moreover, since the housing 81 requires two housings (namely, the first housing 811 and the second housing 812), more components are used and the overall structure is more complex. In addition, since the heat sink 82, light-emitting element 83 and cooling fan 84 are contained in the housing 81, it is required to form a plurality of holes as the air outlet portion 811*a* and the air inlet portion 812*a* on the housing 81. This results in an inconvenience in processing the conventional lamp 8 and increases the manufacturing costs of the conventional lamp 8.

In some occasions, it is required to partially insert the conventional lamp 8 into a decorative ceiling consisting of a plurality of ceiling panels for aesthetic consideration. Therefore, the air outlet portion 811*a* and the air inlet portion 812*a* will be settled into a confined space right above the decorative ceiling where the ventilation is poor while leaving only the light-emitting element 83 beneath the decorative ceiling for illumination purpose. As a result, the heat of the conventional lamp 8 will accumulate in the confined space, shortening the service life of the conventional lamp 8.

Still further, referring to FIG. 3, Taiwanese Patent No. M368765 discloses an outdoor LED lamp 9. The outdoor LED lamp 9 includes a base plate 91 having a first ventilation portion 911 and a second ventilation portion 912. The base plate 91 is coupled with a cooling air-guiding cover 92, with a cooling fan 93 disposed between the first ventilation portion 911 and the second ventilation portion 912. In such an arrangement, the cooling fan 93 can drive air to enter the cooling air-guiding cover 92 via the first ventilation portion 911 and expel air via the second ventilation portion 912, thus dispelling the heat generated by LEDs mounted on the base plate 91.

Similar to the conventional lamp 8, however, it is also difficult to clean the outdoor LED lamp 9 as the cooling fan 93 of the outdoor LED lamp 9 is located between the first ventilation portion 911 and the second ventilation portion 912. Furthermore, the base plate 91 also requires forming the first ventilation portion 911 and the second ventilation portion 912, causing much inconvenience in manufacturing.

SUMMARY OF THE INVENTION

It is therefore the primary objective of this invention to provide a lamp with a simple structure that can form an air-flowing room that allows air to flow therein smoothly for cooling purpose. Thus, the overall structural complexity of the lamp is reduced.

It is another objective of this invention to provide a lamp that reduces the chances of dust accumulation and provides easy cleaning function.

It is yet another objective of this invention to provide a lamp without forming any air inlet or air outlet on a housing thereof, thereby reducing the structural complexity of the lamp for convenient manufacturing.

It is yet another objective of this invention to provide a lamp which provides smooth air circulation with external air, thus improving the cooling effect and maintaining normal operation of the lamp.

The invention discloses a lamp including a heat conducting member, a light-emitting module, a housing and a cooling fan. The heat conducting member has a first face and a second face opposite to the first face. The light-emitting module is coupled with the first face of the heat conducting member. The housing is coupled with the heat conducting member and has a terminal opening, wherein a first air-guiding opening and a second air-guiding opening are formed between the terminal opening and the heat conducting member. The housing has an inner circumferential wall. An air-flowing room is formed between the inner circumferential wall and the second face of the heat conducting member. The air-flowing room communicates with the first air-guiding opening and the second air-guiding opening. The cooling fan is disposed at the first air-guiding opening or the second air-guiding opening and has a first air-driving opening and a second air-driving opening, wherein the first air-driving opening faces the air-flowing room and the second air-driving opening faces the first or second air-guiding opening of the housing.

BRIEF DESCRIPTION OF THE DRAWINGS

The present invention will become more fully understood from the detailed description given hereinafter and the accompanying drawings which are given by way of illustration only, and thus are not limitative of the present invention, and wherein.

Figure 1:
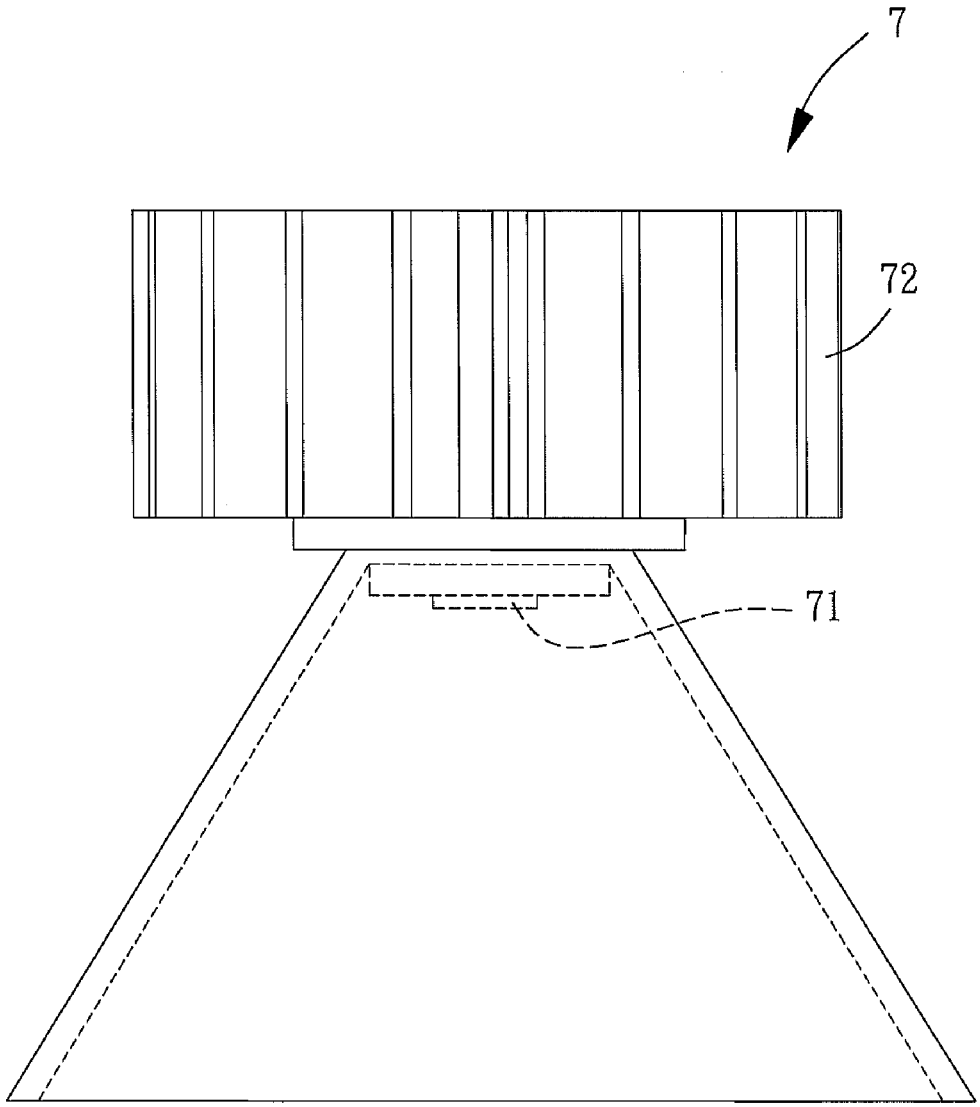
FIG. 1 PRIOR ART
FIG. 1 shows a conventional lamp.
Figure 2:
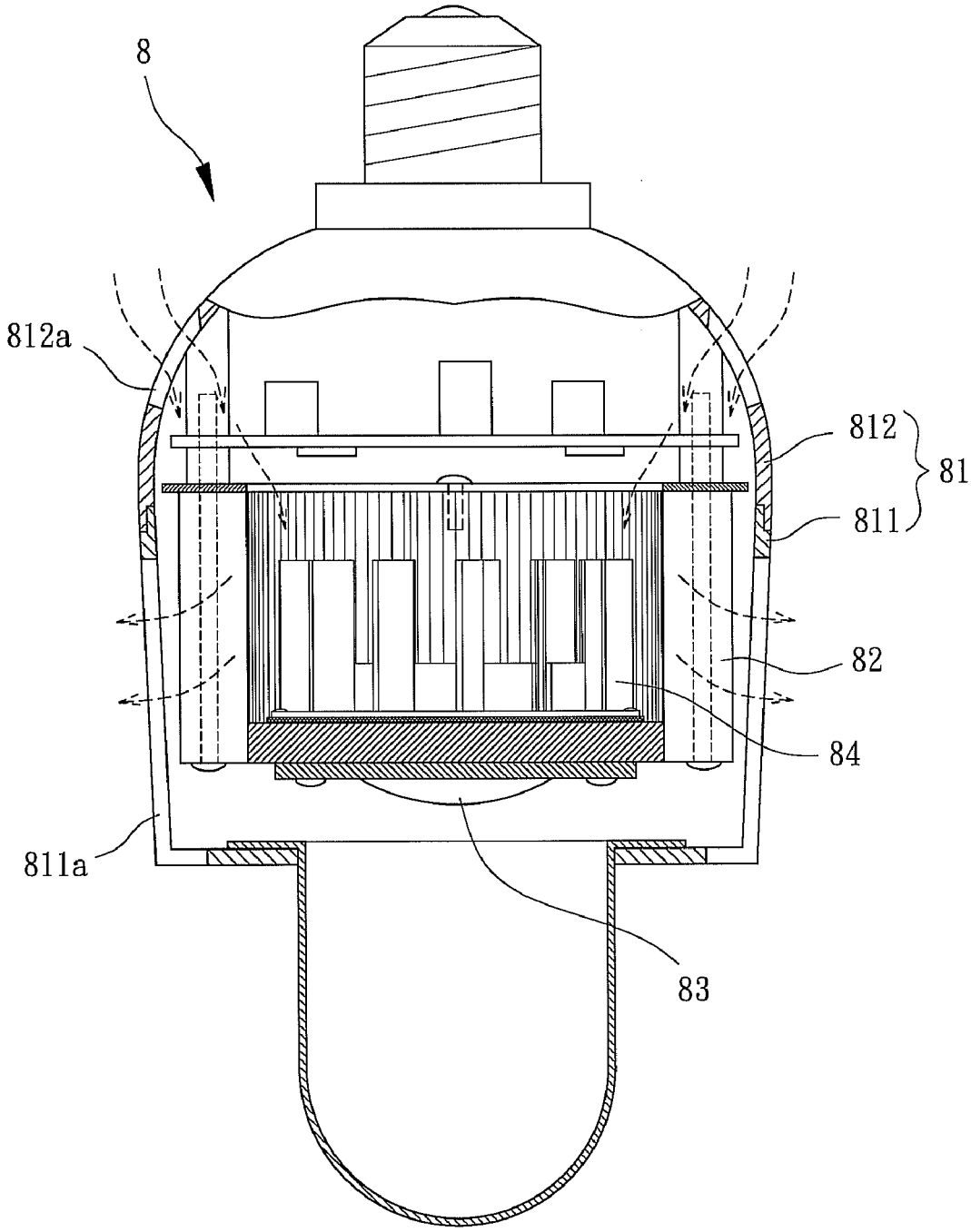
FIG. 2 PRIOR ART
FIG. 2 shows a cross-sectional view of another conventional lamp.
Figure 3:
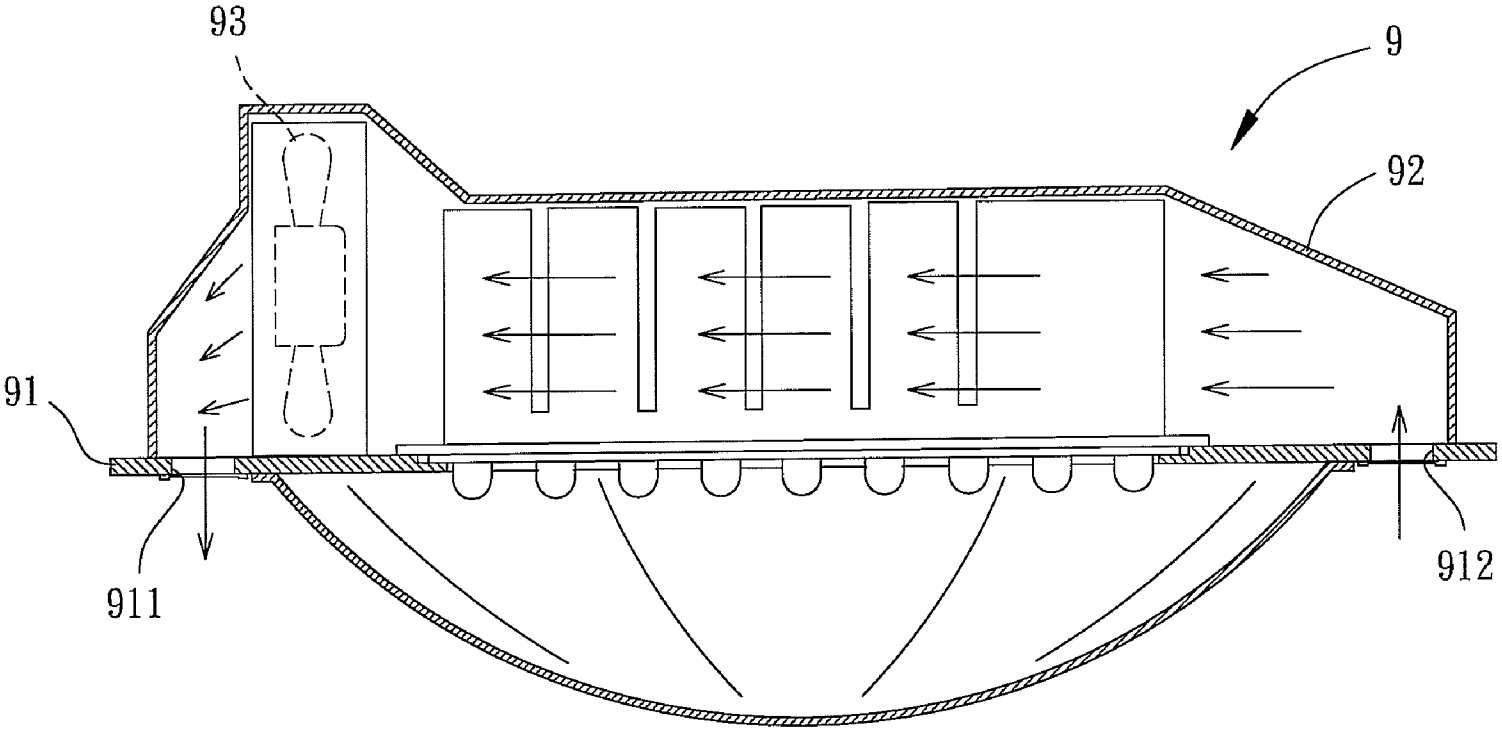
FIG. 3 PRIOR ART
FIG. 3 shows a cross-sectional view of yet another conventional lamp.

In the various figures of the drawings, the same numerals designate the same or similar parts. Furthermore, when the term "first", "second", "third", "fourth", "inner", "outer" "top", "bottom" and similar terms are used hereinafter, it should be understood that these terms refer only to the structure shown in the drawings as it would appear to a person viewing the drawings, and are utilized only to facilitate describing the invention.

DETAILED DESCRIPTION OF THE INVENTION

Figure 4:
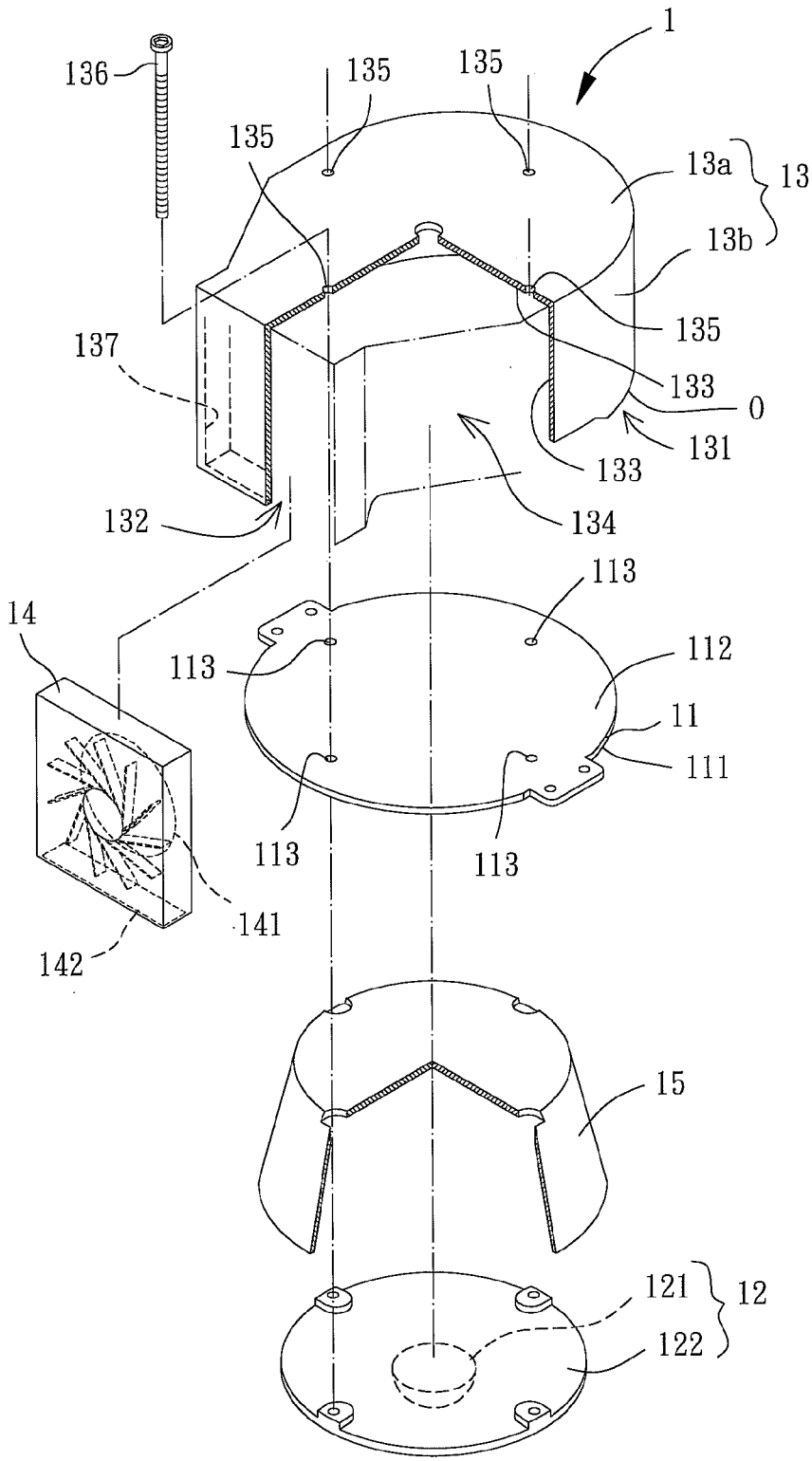
FIG. 4 shows an exploded diagram of a lamp according to a first embodiment of the invention.
Figure 5:
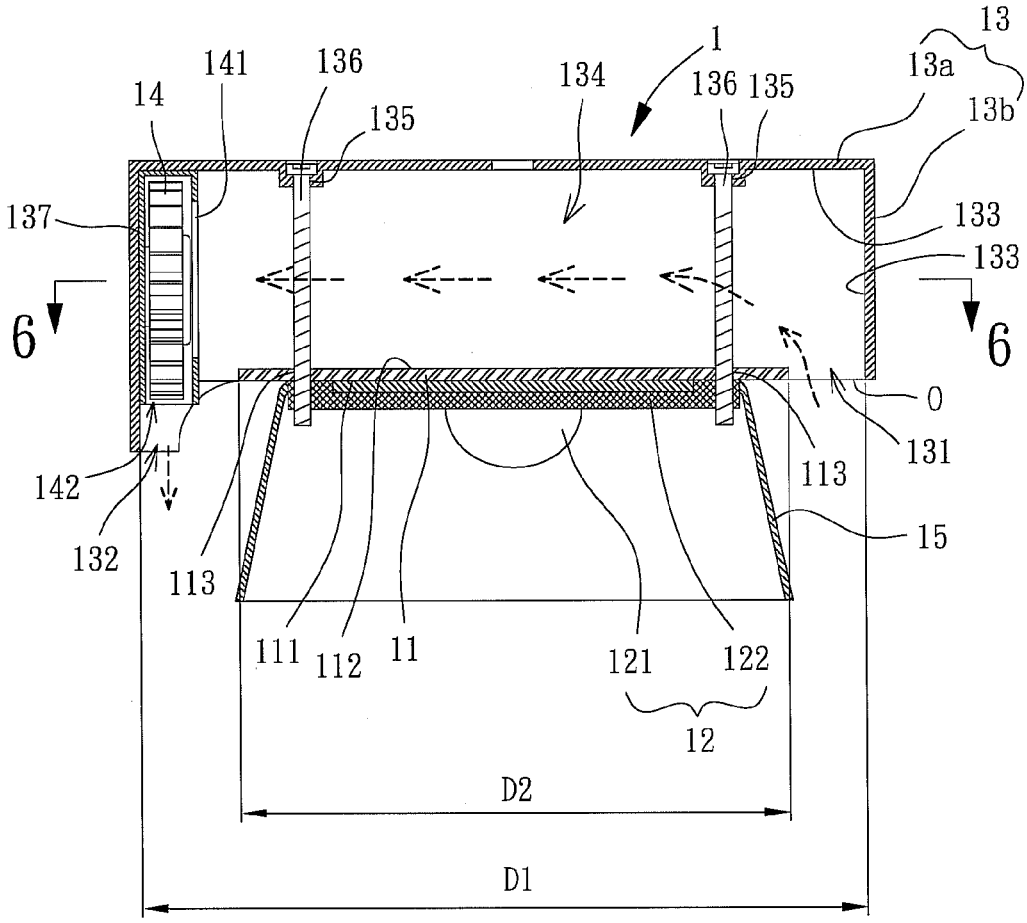
FIG. 5 shows a cross-sectional view of the lamp of the first embodiment of the invention.
Figure 6:
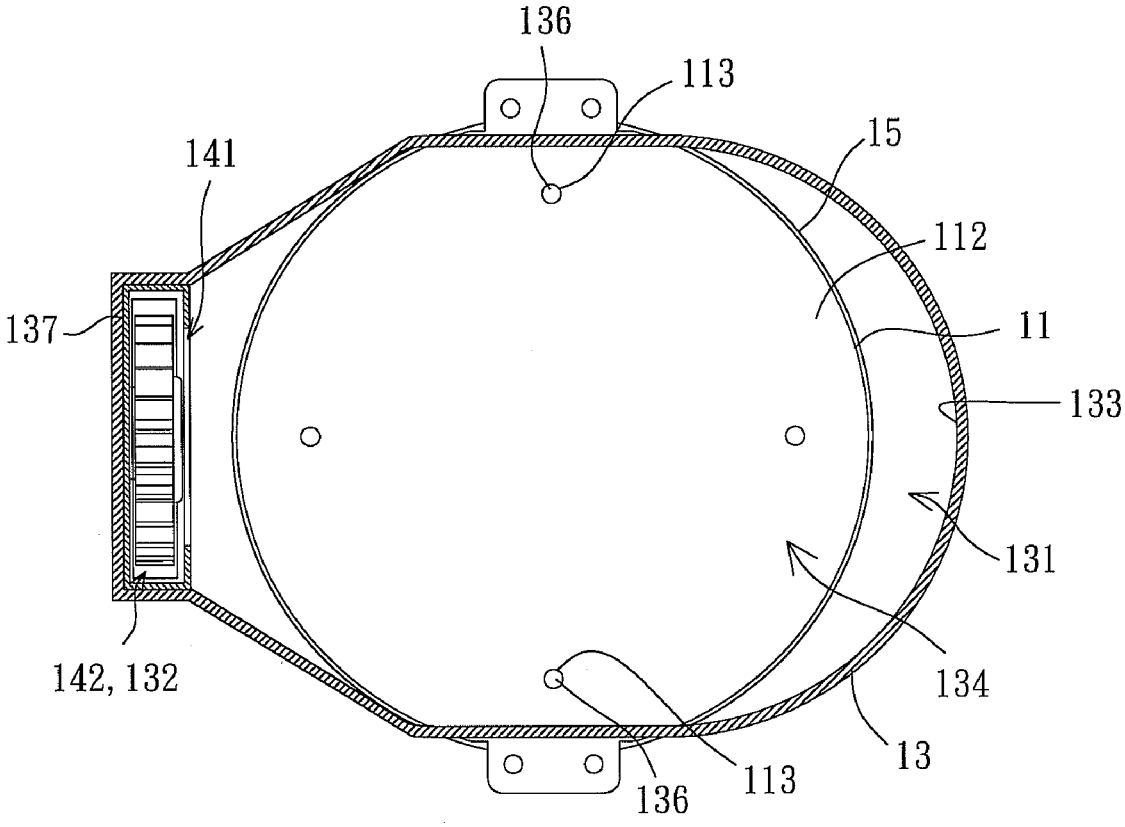
FIG. 6 shows a cross-sectional view of the lamp of the first embodiment observed at line 6-6 shown in FIG. 5.

Referring to FIGS. 4 to 6, a lamp 1 includes a heat conducting member 11, a light-emitting module 12, a housing 13 and a cooling fan 14 according to a first embodiment of the invention. The light-emitting module 12 and the housing 13 are both coupled with the heat conducting member 11 to form a structure that allows air to flow therethrough. The cooling fan 14 is disposed in the housing 13 for air-guiding purpose.

The heat conducting member 11 is made of material with excellent heat conductivity and can be in any form such as a plate, a thick and solid structure or a ring. In the embodiment, the heat conducting member 11 is implemented as a plate having a first face 111 and a second face 112 opposite to the first face 111. The heat conducting member 11 further includes a plurality of fixing holes 113 for coupling with the housing 13.

The light-emitting module 12 is coupled with the first face 111 of the heat conducting member 11 and includes a light-emitting device 121 and a control board 122. The light-emitting device 121 can be a light-emitting diode (LED) module, a bulb or any other device with light-emitting function. The control board 122 is electrically connected to the light-emitting device 121 so that it can control the light-emitting device 121 to emit light.

In this embodiment, the light-emitting device 121 is implemented as a LED module for longer service life and power saving. The control board 122 abuts against the first face 111 of the heat conducting member 11 so that the heat conducting member 11 can reduce the temperature of the light-emitting module 12 for better cooling efficiency.

The housing 13 is coupled with the heat conducting member 11 and has a terminal opening O, with a first air-guiding opening 131 and a second air-guiding opening 132 formed between the terminal opening O and the heat conducting member 11. The terminal opening O has a minimal diameter D1 that should be designed to be larger than a maximal diameter D2 of the heat conducting member 11 so that a desired amount of air can pass through the first air-guiding opening 131 and the second air-guiding opening 132. In addition, the housing 13 has an inner circumferential wall 133 and an air-flowing room 134 is formed between the inner circumferential wall 133 and the second face 112 of the heat conducting member 11, with the air-flowing room 134 communicating with the first air-guiding opening 131 and the second air-guiding opening 132. Both the first air-guiding opening 131 and the second air-guiding opening 132 can act as an air inlet or air outlet, depending on the rotation direction of the cooling fan 14. For instance, the first air-guiding opening 131 can serve as an air inlet and the second air-guiding opening 132 can serve as an air outlet or, alternatively, the first air-guiding opening 131 can serve as an air outlet and the second air-guiding opening 132 can serve as an air inlet.

In the embodiment, the housing 13 consists of a base plate 13*a* and a lateral annular wall 13*b* located on a periphery of the base plate 13*a*, with the base plate 13*a* having a plurality of through-holes 135. Based on this, a fixing member 136 such as a screw or screw bolt can be extended through the through-hole 135 to fix with the fixing hole 113 of the heat conducting member 11, thereby firmly coupling the housing 13 with the heat conducting member 11. Furthermore, due to a distance presented between the base plate 13*a* and the heat conducting member 11, an inner side of the lateral annular wall 13*b*, at which the base plate 13*a* is disposed, and the base plate 13*a* can jointly form the inner circumferential wall 133 of the housing 13. The lateral annular wall 13*b* of the housing 13 can form a coupling portion 137 at the second air-guiding opening 132 (or at the first air-guiding opening 131). The coupling portion 137 is located in the air-flowing room 134 and may be of any structure capable of coupling with the cooling fan 14. Thus, the cooling fan 14 can be coupled with the housing 13.

The cooling fan 14 is disposed in the air-flowing room 134 of the housing 13 at the first air-guiding opening 131 or the second air-guiding opening 132. The cooling fan 14 is away from the second air-guiding opening 132 when located at the first air-guiding opening 131 or, on the contrary, is away from the first air-guiding opening 131 when located at the second air-guiding opening 132. The cooling fan 14 may be an axial flow fan or centrifugal fan, with the centrifugal fan preferred. The cooling fan 14 has a first air-driving opening 141 and a second air-driving opening 142, with the first air-driving opening 141 facing the air-flowing room 134 and the second air-driving opening 142 facing and connecting to the first air-guiding opening 131 or the second air-guiding opening 132 of the housing 13. This exposes the second air-driving opening 142 of the cooling fan 14 to the outside via the first air-guiding opening 131 or the second air-guiding opening 132 for convenient cleaning of the cooling fan 14.

In this embodiment, the cooling fan 14 is implemented as a centrifugal fan and lodged in the coupling portion 137 of the housing 13, which locates the cooling fan 14 at the second air-guiding opening 132. Since the cooling fan 14 is a centrifugal fan, the first air-driving opening 141 and the second air-driving opening 142 can drive the air in horizontal and vertical directions respectively (according to component arrangements in FIGS. 4 and 5). When the cooling fan 14 is disposed in the air-flowing room 134 via the coupling portion 137, the cooling fan 14 can horizontally draw the air from the air-flowing room 134 via the first air-driving opening 141 and vertically expel the air from the air-flowing room 134 via the second air-driving opening 142. Therefore, the cooling fan 14 can guide the air in and out of the air-flowing room 134 from different directions to improve the overall cooling efficiency of the lamp 1.

The lamp 1 of the first embodiment of the invention may further comprise a lampshade 15 that receives the light-emitting module 12. The lampshade 15 can be coupled with the heat conducting member 11 in a manner that it does not hinder the air from flowing through the first air-guiding opening 131 and the second air-guiding opening 132. In such an arrangement, the light-emitting module 12 can emit light through the lampshade 15 for better illumination effect while being protected by the lampshade 15.

When the lamp 1 of the invention is in use, the lamp 1 can be partially lodged in places such as a wall or ceiling for illumination purpose. As an example, the lamp 1 can be partially inserted into a decorative ceiling consisting of a plurality of ceiling panels in a way that the housing 13 of the lamp 1 is settled in a confined space right above the decorative ceiling while leaving only the first air-guiding opening 131 and the second air-guiding opening 132 beneath the decorative ceiling for air circulation. Moreover, the control board 122 of the light-emitting module 12 may be electrically connected to a general power supply system so that the control board 122 can control the light-emitting device 121 to emit light. As shown in FIG. 4, when the cooling fan 14 operates, the air can be drawn into the air-flowing room 134 via the first air-guiding opening 131. The drawn air then flows past the heat conducting member 11 to dispel the heat thereon generated by the light-emitting module 12. Finally, the air in the lamp 1 is expelled via the second air-guiding opening 132.

Based on the disclosed structures, the lamp 1 of the invention is characterized as follows.

First, the lamp 1 of the invention may form the air-flowing room 134 between the housing 13 and the heat conducting member 11 such that the cooling fan 14 may guide the air via the first air-guiding opening 131 and the second air-guiding opening 132 to provide a predetermined cooling function. Therefore, the air-flowing room 134 of the lamp 1 has a simple shape that allows the air to flow therein more smoothly. Further, the lamp 1 forms the air-flowing room 134 by simply combining the housing 13 and the heat conducting member 11, thereby efficiently reducing the overall structural complexity of the lamp 1. In overall, the lamp 1 of the invention can provide an improved cooling effect and improves the assembly convenience.

Second, since the cooling fan 14 of the lamp 1 is disposed at the first air-guiding opening 131 or the second air-guiding opening 132, the invention as opposed to the conventional lamps 8 and 9 avoids arranging the cooling fan 14 between the first air-guiding opening 131 and the second air-guiding opening 132. Moreover, the first air-guiding opening 131 and the second air-guiding opening 132 are designed in a simple structure, reducing the amount of dust accumulated on the first air-guiding opening 131 and the second air-guiding opening 132. Although some dust has remained on the cooling fan 14 disposed at the first air-guiding opening 131 or the second air-guiding opening 132, the cooling fan 14 can be easily taken out and cleaned as the first air-guiding opening 131 and the second air-guiding opening 132 are located near outside of the lamp 1. Thus, convenient cleaning of the lamp 1 is provided.

Third, since the lamp 1 of the invention is able to form the first air-guiding opening 131 and the second air-guiding opening 132 by arranging the heat conducting member 11 at the terminal opening O of the housing 13, the invention does not require forming any air inlet or air outlet on the housing 13 and the heat conducting member 11. This simplifies the structural complexity, improves manufacturing convenience and reduces the manufacturing costs of the lamp 1.

Fourth, since both the first air-guiding opening 131 and the second air-guiding opening 132 are formed between the housing 13 and the heat conducting member 11, the first air-guiding opening 131 and the second air-guiding opening 132 can be located beneath the decorative ceiling for communication with external air when the lamp 1 is partially inserted into the decorative ceiling. Thus, the cooling fan 14 can smoothly guide the air in and out of the lamp 1 for better cooling effect. Also, the service life of the lamp 1 is prolonged.

Figure 7:
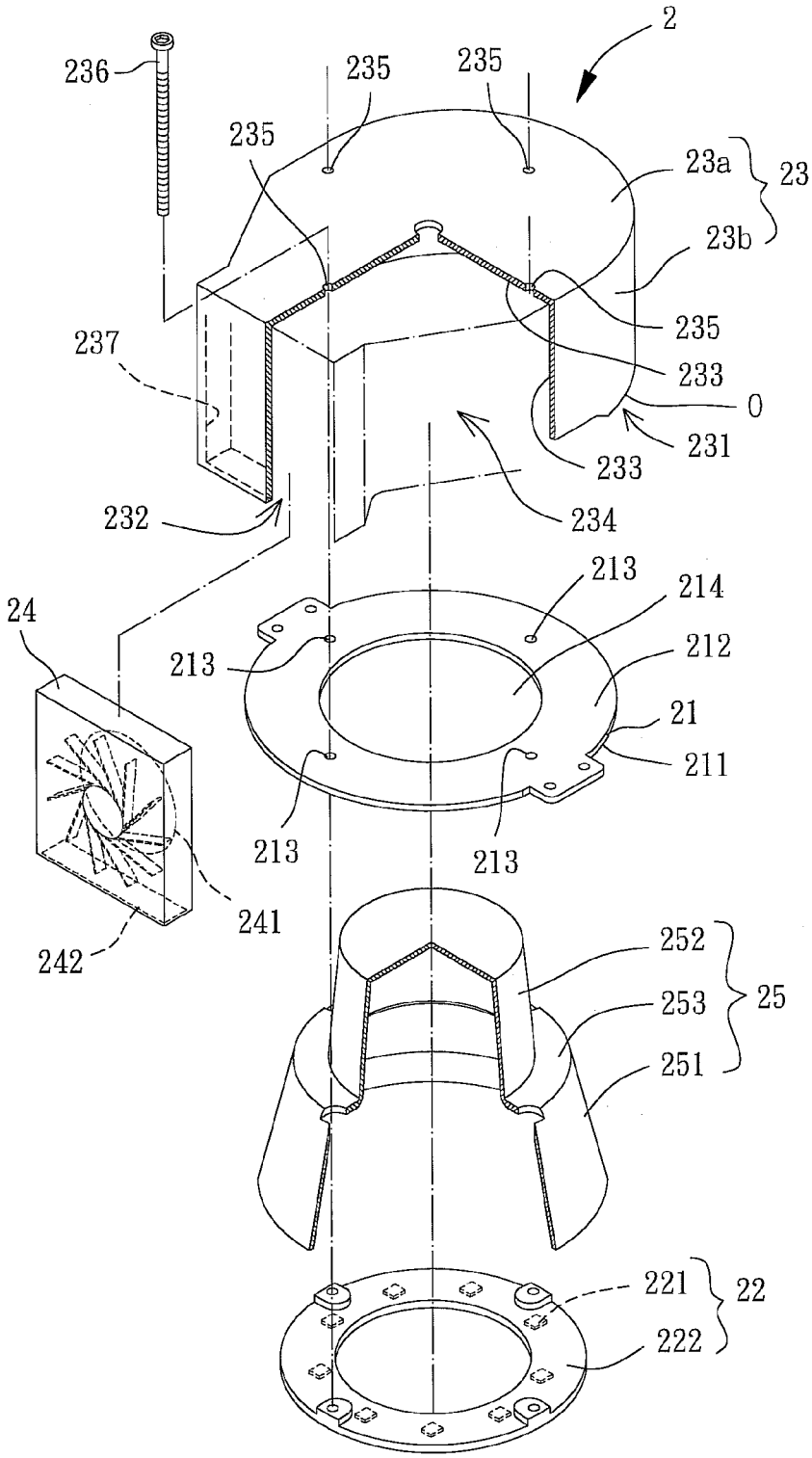
FIG. 7 shows an exploded diagram of a lamp according to a second embodiment of the invention.
Figure 8:
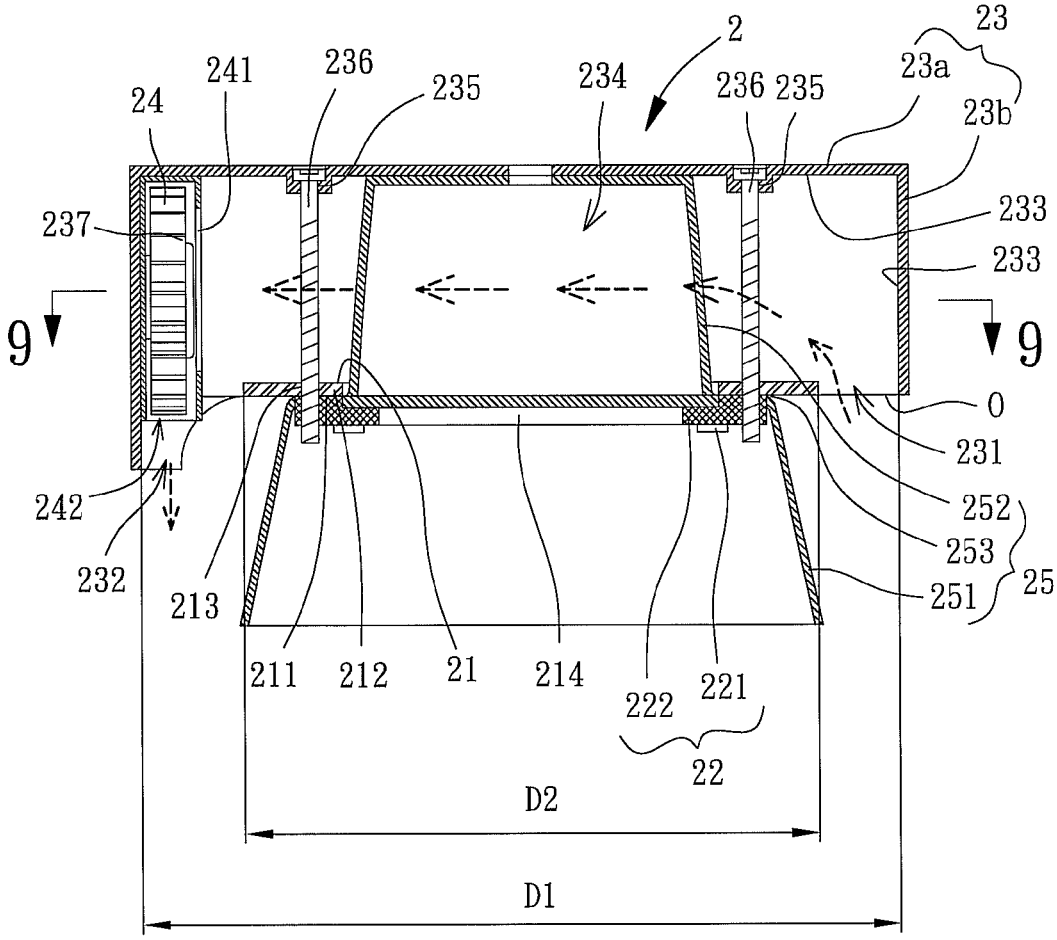
FIG. 8 shows a cross-sectional view of the lamp of the second embodiment of the invention.
Figure 9:
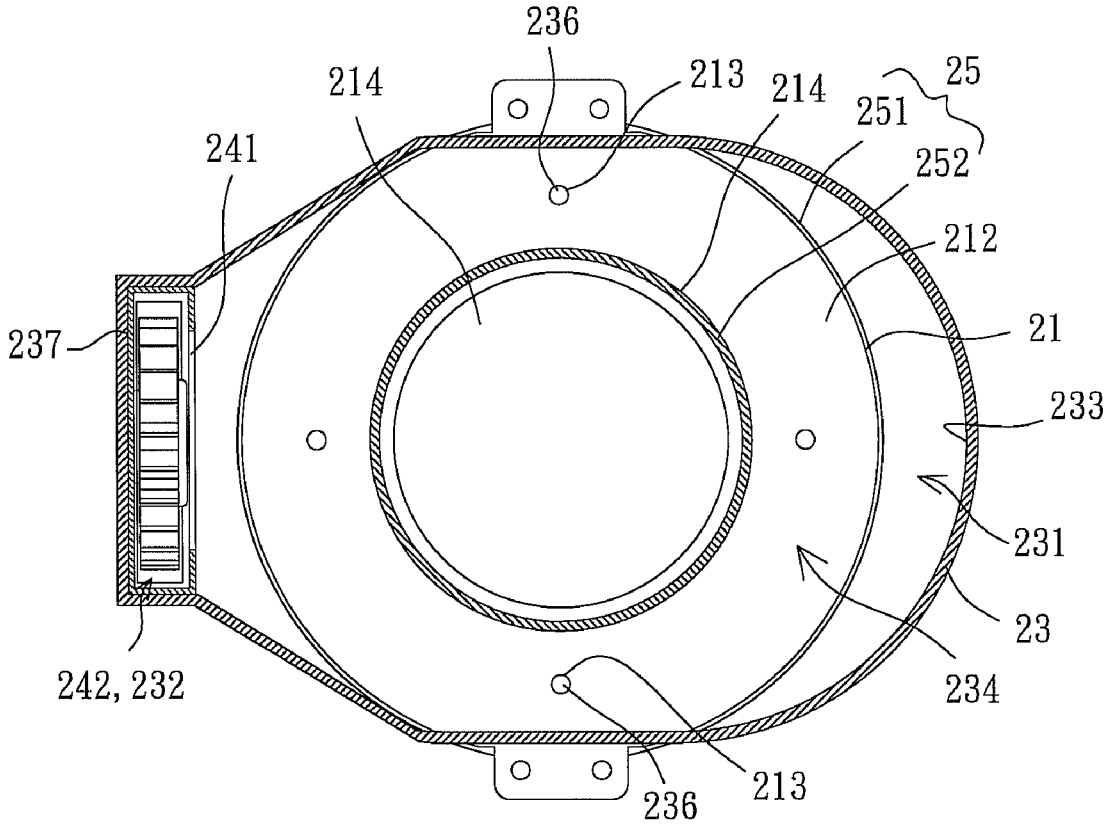
FIG. 9 shows a cross-sectional view of the lamp of the second embodiment observed at line 9-9 shown in FIG. 8.

Referring to FIGS. 7 to 9, a lamp 2 also includes a heat conducting member 21, a light-emitting module 22, a housing 23, a cooling fan 24 and a lampshade 25 according to a second embodiment of the invention. The mutual combinations of the heat conducting member 21, light-emitting module 22, housing 23, cooling fan 24 and lampshade 25 are similar to the heat conducting member 11, light-emitting module 12, housing 13, cooling fan 14 and lampshade 15 of the lamp 1 of the first embodiment, so they are not described herein again.

Further, the lamp 2 includes a housing 23 having a base plate 23*a*, a lateral annular wall 23*b*, a first air-guiding opening 231, a second air-guiding opening 232, an inner circumferential wall 233, an air-flowing room 234, a plurality of through-holes 235, a plurality of fixing members 236 and a coupling portion 237 that are also similar to the base plate 13*a*, lateral annular wall 13*b*, first air-guiding opening 131, second air-guiding opening 132, inner circumferential wall 133, air-flowing room 134, through-holes 135, fixing members 136 and coupling portion 137 of the housing 13 of the lamp 1. Further, the lamp 2 includes a cooling fan 24 having a first air-driving opening 241 and a second air-driving opening 242 that are similar to the first air-driving opening 141 and the second air-driving opening 142 of the cooling fan 14. Thus, those components are not described herein again for brevity.

The heat conducting member 21 of this embodiment also includes a first face 211 and a second face 212 opposite to the first face 211. In this embodiment, the heat conducting member 21 is implemented as a ring plate having a plurality of fixing holes 213 on a periphery thereof. The heat conducting member 21 also has a fitting hole 214 at a center thereof through which the lampshade 25 is fitted.

The light-emitting module 22 of the second embodiment includes a plurality of light-emitting devices 221 and a control board 222 in the form of a ring. The light-emitting devices 221 are annularly mounted on the control board 222. The control board 222 is also coupled with the first face 211 of the heat conducting member 21 so that the light-emitting devices 221 can be mounted around the fitting hole 214.

The lampshade 25 includes a ring portion 251 and a cover portion 252 connected to one end of the ring portion 251, with a positioning shoulder portion 253 formed on where the ring portion 251 and the cover portion 252 are joined. In such an arrangement, the heat conducting member 21 can be fitted around the cover portion 252 of the lampshade 25 via the fitting hole 214. In this way, the first face 211 of the heat conducting member 21 can abut against the positioning shoulder portion 253 while the cover portion 252 protrudes from the second face 212 of the heat conducting member 21. Thus, the cover portion 252 can be located in the air-flowing room 234 to form an annular air path.

The lamp 2 of the second embodiment is characterized in forming the annular air path using the cover portion 252. This allows the air drawn into the air-flowing room 234 to flow past the heat conducting member 21 along the annular air path. In contrast to the first embodiment, the air drawn by the cooling fan 24 can flow past the heat conducting member 21 along the annular air path and then be expelled via the second air-guiding opening 232. This efficiently dispels the heat of the light-emitting module 22 and the heat conducting member 21 and improves the overall cooling efficiency of the lamp 2.

Figure 10:
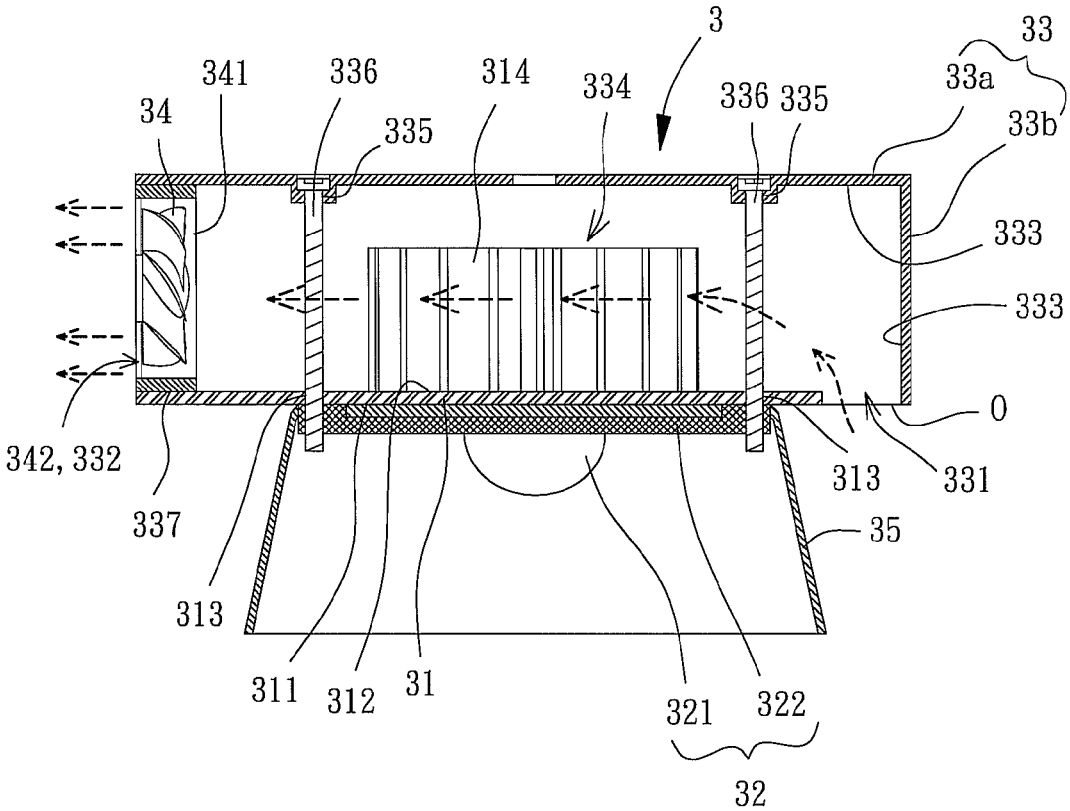
FIG. 10 shows a cross-sectional view of a lamp according to a third embodiment of the invention.

Referring to FIG. 10, a lamp 3 also includes a heat conducting member 31, a light-emitting module 32, a housing 33, a cooling fan 34 and a lampshade 35 according to a third embodiment of the invention. The mutual combinations of the heat conducting member 31, light-emitting module 32, housing 33, cooling fan 34 and lampshade 35 are similar to the heat conducting member 11, light-emitting module 12, housing 13, cooling fan 14 and lampshade 15 of the lamp 1 of the first embodiment, so they are not described herein again. The embodiment differs from the first embodiment in that the cooling fan 34 is implemented as an axial flow fan.

The light-emitting module 32 also includes a light-emitting device 321 and a control board 322 that are similar to the light-emitting device 121 and the control board 122 of the lamp 1 of the first embodiment. Further, the housing 33 also includes a base plate 33*a*, a lateral annular wall 33*b*, a first air-guiding opening 331, an inner circumferential wall 333, an air-flowing room 334, a plurality of through-holes 335 and a plurality of fixing members 336 that are similar to the base plate 13*a*, lateral annular wall 13*b*, first air-guiding opening 131, inner circumferential wall 133, air-flowing room 134, through-holes 135 and fixing members 136 of the lamp 1 of the first embodiment. Further, the cooling fan 34 also includes a first air-driving opening 341 similar to the first air-driving opening 141 of the lamp 1. Therefore, those components are not described herein again for brevity. Since the cooling fan 34 is an axial flow fan, it will further include a second air-driving opening 342 opposite to the first air-driving opening 341, with the housing 33 further including a second air-guiding opening 332 communicating with the second air-driving opening 342 of the cooling fan 34. Therefore, the cooling fan 34 can guide the air in and out of the housing 33 via the second air-driving opening 342 and the second air-guiding opening 332.

The heat conducting member 31 of this embodiment also includes a first face 311 and a second face 312 opposite to the first face 311. In this embodiment, the heat conducting member 31 further includes a plurality of fixing holes 313 for coupling with the housing 33. In this embodiment, the second face 312 of the heat conducting member 31 includes a plurality of fins 314 located in the air-flowing room 334 after the assembly of the lamp 3 is completed. Although a coupling portion 337 of the housing 33 has a slightly different shape from the coupling portion 137 of the lamp 1, it does provide the same function of fixing the cooling fan 34.

The lamp 3 of the third embodiment is characterized in increasing the heat exchange areas of the heat conducting member 31 using the fins 314 of the heat conducting member 31. In this way, the cooling effect of the heat conducting member 31 can be improved.

In conclusion, the lamps 1, 2 and 3 of the invention do provide advantages of improved cooling effect, convenient assembly and cleaning, and cost reduction. Thus, the service life of the lamps 1, 2 and 3 is increased.

Although the invention has been described in detail with reference to its presently preferable embodiment, it will be understood by one of ordinary skill in the art that various modifications can be made without departing from the spirit and the scope of the invention, as set forth in the appended claims.

What is claimed is:

1. A lamp, comprising:

a heat conducting member having a first face and a second face opposite to the first face;

a light-emitting module coupled with the first face of the heat conducting member;

a housing coupled with the heat conducting member and having a terminal opening, wherein a first air-guiding opening and a second air-guiding opening are formed between the terminal opening and the heat conducting member, the housing has an inner circumferential wall, an air-flowing room is formed between the inner circumferential wall and the second face of the heat conducting member, and the air-flowing room communicates with the first air-guiding opening and the second air-guiding opening; and a cooling fan disposed at the first air-guiding opening or the second air-guiding opening and having a first air-driving opening and a second air-driving opening, wherein the first air-driving opening faces the air-flowing room and the second air-driving opening faces the first or second air-guiding opening of the housing.

2. The lamp as claimed in claim 1, further comprising a lampshade receiving the light-emitting module and coupled with the heat conducting member.

3. The lamp as claimed in claim 2, wherein the lampshade includes a ring portion and a cover portion connected to one end of the ring portion, the heat conducting member has a fitting hole through which the cover portion of the lampshade is fitted, and the cover portion protrudes from the second face of the heat conducting member so that the air-flowing room is formed as an annular air path.

4. The lamp as claimed in claim 3, wherein a positioning shoulder portion is formed on where the ring portion and the cover portion are joined, and the first face of the heat conducting member abuts against the positioning shoulder portion.

5. The lamp as claimed in claim 1, wherein the light-emitting module includes at least one light-emitting device and a control board on which the at least one light-emitting device is mounted, and the control board is coupled with the first face of the heat conducting member.

6. The lamp as claimed in claim 5, wherein the control board is in the form of a ring, and the at least one light-emitting device includes a plurality of light-emitting devices annularly mounted on the control board.

7. The lamp as claimed in claim 1, wherein the second face of the heat conducting member includes a plurality of fins located in the air-flowing room.

8. The lamp as claimed in claim 1, wherein the housing includes a base plate and a lateral annular wall located on a periphery of the base plate, a distance is presented between the base plate and the heat conducting member, and an inner side of the lateral annular wall, at which the base plate is disposed, and the base plate jointly form the inner circumferential wall of the housing.

9. The lamp as claimed in claim 8, wherein the lateral annular wall of the housing forms a coupling portion at the first or second air-guiding opening, the coupling portion is located in the air-flowing room and the cooling fan is lodged in the coupling portion.

10. The lamp as claimed in claim 8, wherein the heat conducting member further includes a plurality of fixing holes and the base plate has a plurality of through-holes, and a plurality of fixing members is extended through the through-holes of the base plate to fix with the fixing holes of the heat conducting member.

11. The lamp as claimed in claim 1, wherein the cooling fan is a centrifugal fan.

12. The lamp as claimed in claim 1, wherein the cooling fan is an axial flow fan.

13. The lamp as claimed in claim 1, wherein the terminal opening has a minimal diameter larger than a maximal diameter of the heat conducting member.

14. The lamp as claimed in claim 1, wherein the second air-driving opening of the cooling fan is connected to the first or second air-guiding opening of the housing.

* * * * *